United States Patent [19]

Hanaoka

[11] 4,033,256

[45] July 5, 1977

[54] PRINTER

[75] Inventor: Seiji Hanaoka, Shiojiri, Japan

[73] Assignee: Kabushiki Kaisha Suwa Seikosha, Tokyo, Japan

[22] Filed: May 9, 1975

[21] Appl. No.: 575,814

[30] Foreign Application Priority Data

May 9, 1974 Japan ..... 49-51470

[52] U.S. Cl. ..... 101/99; 101/95; 101/110

[51] Int. Cl.[2] ..... B41J 1/44

[58] Field of Search ..... 101/95, 96, 99, 110, 101/93.22, 93.28–93.31, 93.41, 93.42, 93.48

[56] References Cited

UNITED STATES PATENTS

| | | | |
|---|---|---|---|
| 3,176,610 | 4/1965 | Benson et al. | 101/93.28 |
| 3,261,283 | 7/1966 | Vroom et al. | 101/95 |
| 3,422,754 | 1/1969 | Bakgodjier et al. | 101/99 X |
| 3,605,611 | 9/1971 | Konkel et al. | 101/93.48 X |
| 3,861,302 | 1/1975 | Mizutani et al. | 101/99 |
| 3,874,286 | 4/1975 | Ishikawa | 101/95 X |
| 3,875,859 | 4/1975 | Busch | 101/93.28 |
| 3,884,144 | 5/1975 | Shimodairn | 101/95 X |

*Primary Examiner*—Edward M. Coven
*Attorney, Agent, or Firm*—Blum, Moscovitz, Friedman & Kaplan

[57] ABSTRACT

An improved printer comprising a plurality of character rings provided with a plurality of characters on the respective peripheries thereof and corresponding pluralities of ratchet wheels and pawls. Each ratchet wheel is radially mounted on a character ring and a corresponding pawl is oscillatably mounted for engaging its corresponding ratchet at a preselected interval for stopping its associated character ring when a selected character is located at a predetermined position. Guides are provided for determining the constancy of oscillation of the pawls. Each pawl is spring driven into engagement with a corresponding ratchet wheel and a normal bias toward a corresponding ratchet wheel is provided. A releasable restraint acts oppositely to the bias on the pawl for normally preventing the pawl from engaging with its corresponding ratchet wheel. An electromagnetic device is provided for transducing an electronic signal into a mechanical motion which releases the restraint on the pawl whereby the bias on the pawl drives the pawl into engagement with its corresponding ratchet wheel and the character ring associated therewith is thereby fixed for aligning a preselected character in the strike path of an actuable platen. At a print command the platen abuts the character in its path and a paper or like imprint receiver is provided with an imprint of the preselected character.

8 Claims, 5 Drawing Figures

PRINTER

BACKGROUND OF THE INVENTION

This invention relates to printers, and more particularly to electrically responsive printer devices.

Conventional printers are cumbersome and erratic. Moreover, parts replacements are frequently required and the complexities of the devices, in general, foreshorten their useful lives.

There is, therefore, an expanding need for rapid, efficient and compact printers. Fabricators of these devices constantly seek an optimal balance among rapidity, efficiency and accuracy.

SUMMARY OF THE INVENTION

Generally speaking, in accordance with the invention, there is provided an improved printer comprising a plurality of character rings provided with a plurality of characters on the respective peripheries thereof and corresponding pluralities of ratchel wheels and pawls. Each ratchet wheel is radially mounted on a character ring and a corresponding pawl is oscillatably mounted for engaging its corresponding ratchet at a preselected interval for stopping its associated character ring when a selected character is located at a predetermined position. Guides are provided for determining the constancy of oscillation of the pawls. Each pawl is spring driven into engagement with a corresponding ratchel wheel and a normal bias toward a corresponding ratchet wheel is provided.

A releasable restraint acts oppositely to the bias on the pawl for normally preventing the pawl from engaging with its corresponding ratchel wheel. An electromagnetic device is provided for transducing an electronic signal into a mechanical motion which releases the restraint on the pawl whereby the bias on the pawl drives the pawl into engagement with its corresponding ratchet wheel and the character ring associated therewith is thereby fixed for aligning a preselected character in the strike path of an actuable platen. At a print command and platen abuts the character in its path and a paper or like imprint receiver is provided with an imprint of the preselected character.

Accordingly, it is an object of this invention to provide an improved printer.

Another object of the invention is to provide a printer with a high degree of accuracy, and a high degree of efficiency.

A further object of the invention is to provide a printer with a compact assembly which is easy to disassemble for part replacements.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
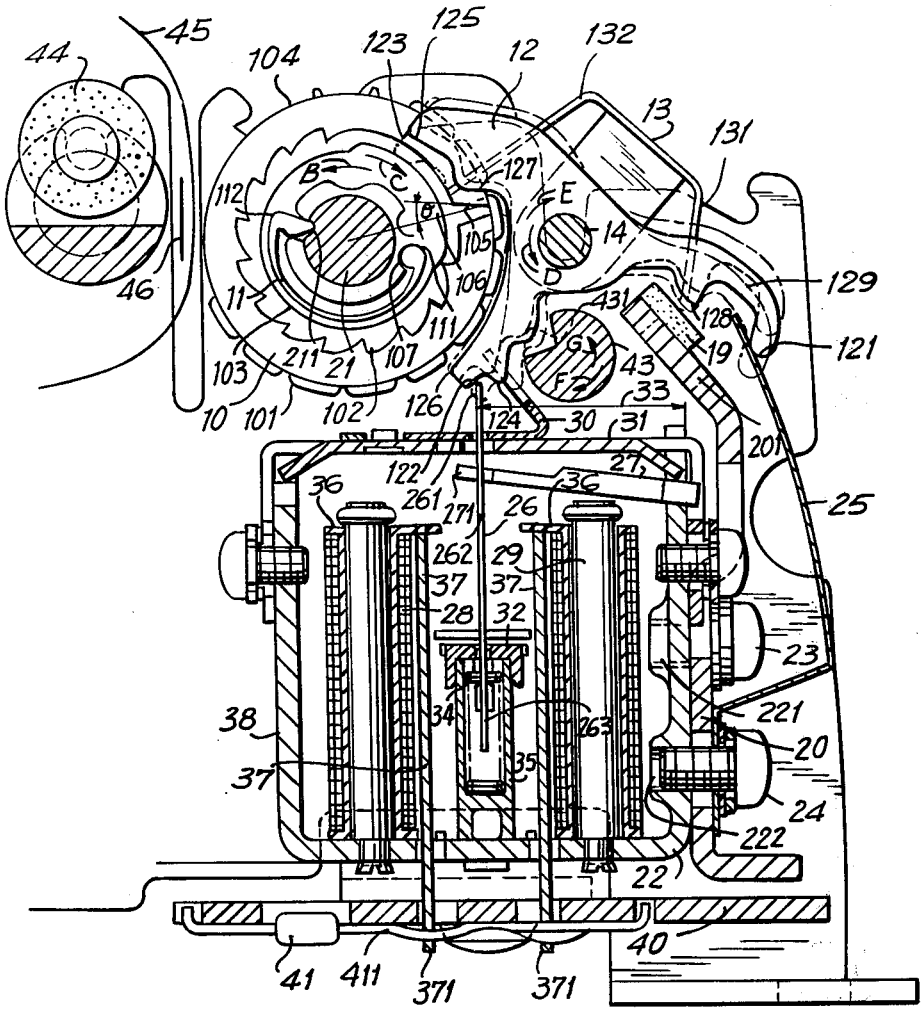
FIG. 1 is a sectional side elevation of a printer constructed in accordance with the instant invention.

Referring now to FIG. 1, a plurality of character rings 10 are arranged independently of each other corresponding to a predetermined number of columns. Character rings 10 are provided with respective pluralities of characters 101 such as letters or symbols on their respective peripheries. Characters 101 of each ring 10 correspond respectively, to teeth of a ratchet wheel 102 which is mounted on a side of each character ring 10. Each character ring 10 is rotatably mounted on a shaft 21. A spring 11 mounted in an interior slot 103 provided in ratchet wheel 102 has a bent portion 111 engaged in a recess 107 provided in character ring 10 and another bent portion 112 freely engageable in a notched groove 211 provided in shaft 21, along the thrust direction of shaft 21. Shaft 21 is connected to a power source (not shown) and driven thereby for rotating shaft 21, respectively in directions C and B. Concomitantly, shaft 21 is stopped when power to the source is shut off. The elastic force of spring member 11 continuously biases bent portion 112 toward the center of the shaft 21, and the constancy of portion 112 of the spring in notched groove 211 determines a substantially fixed relationship among notched groove 211, characters 101 on character ring 10 and the teeth of the ratchet wheel 102.

A pawl 12 is respectively rotatably mounted in corresponding relationship to each character ring 10. Pawl 12 is oscillatable on a support shaft 14 between a pair of slots 131 and 132 provided in a guide member 13. Pawl 12 is rotatable on shaft 14 for engaging a tooth of ratchet wheel 102 for thereby stopping a character 101 on character ring 10 at a desired position.

Leakage of magnetic flux from a yoke 22 of an electro-magnetic device 38 is prevented by a mounting plate 20 made of a non-magnetic material. Mounting plate 20 is fixedly connected between two frames (not shown) for maintaining a predetermined distance therebetween and for providing a rigid support for the printing device. The mounting plate 20 is provided with an upstanding inwardly turned portion 201 on which an elastic member 19 is fixedly connected. In yoke 22, a female screw 221 is tapped and fixedly connected to mounting plate 20 by a screw 23. Additionally, a female screw 222 is tapped in the yoke 22 and an elastic plate provided with comb-shaped springs 25 is mounted on the exterior surface of plate 20 by a screw 24. Each spring 25 engages a crook 121 provided in a respective pawl 12 and provides pawl 12 with a moment for rotating about shaft 14 in a direction D.

When pawl 12 is biased in direction D, a tail portion 122 of each pawl 12 engages an end 261 of a restraining member 26. In a slot 262 provided in each restraining member 26, an end 271 of an electromagnetically attractive plate 27 is mounted. Each restraining member 26 upstands respectively through a slot provided in a first guide member 30 and comb-shaped slot provided in a second guide member 31, while the downwardly extending end thereof is housed in an elongated slot provided in third guide member 32. In the device a predetermined distance 33 is established between plate 20 and restraining member 26. A tail portion 263 of the downwardly extended end of restraining member 26 is mounted in a compression spring 34 housed in a housing 35, and constantly biased upwardly thereby.

When an electric current is applied to electro-magnetic coil 28, a corresponding plate 27 is attracted toward a corresponding iron core 29, and thereby moves restraining member 26 downwardly. The bias of restraining member 26 against tail portion 122 of pawl 12 is released as restraining member 26 is moved downwardly, and pawl 12 is rotated in a direction D by the bias of member 25. If portion 122 of pawl 12 is substantially parallel to the direction of movement of restraining member 26, pawl 12 begins to rotate only when restraining member 26 disengages from end portion 261 thereof. Pawl 12 thereby rotates from its normal position to the position shown in phantom line 123 wherein pawl 12 engages a tooth of ratchet wheel 102 for selecting a character 101. When tail portion 122 has a parallel formation relative to the direction of movement of restraining member 26, the period of rotation is longer than when tail portion 122 has an arbitrarily inclined formation against which restraining member 26 biases tail portion 122 for preventing rotation of the pawl in direction D. Therefore, it is preferable to provide tail portion 122 with an inclined formation to shorten the rotation time of pawl 12 and provide a more efficient means for selecting a character.

Restraining members 26 are positioned by fixing the position of yoke 20 with a screw 23, the respective ends 261 of restraining members 26 being kept in contact with projections 124 of pawls 12. However, if an end 261 of a corresponding restraining member 26 rigidly abuts a tail portion 122 at the peak of its incline, it takes longer for pawl 12 to rotate and character selection reliability thereof is reduced. If the engagement between end 261 and tail portion 122 is too elastic, on the other hand, the engagement therebetween is insufficiently shock resistant. The provision of projections 124 adjacent a tail portion 122 provides for a desirable degree of engagement between restraining member 26 and pawl 12.

Coil bobbins 36 are mounted on first print base plates 37. When the iron cores 29 are fixed in yoke 22, coil bobbins 36 and first print base plates 37 are mounted in yoke 22. Two rows of iron cores 29 are arranged zigzag in yoke 22 at regular intervals. A second print base plate 40 is fixed in yoke 22. Second print base plate 40 is provided with electronic elements generally designated 41 having lead terminals 411 connected to projections 371 provided in first print base plates 37. Electric current is provided to electromagnetic coils 28 through second print base plate 40 and first print base plate 37.

A return shaft 43 is angularly reciprocally rotated by a cam member or the like (not shown), for rotating pawl 12 in a direction E. A platen 44 is arranged for impressing paper 45 against a character 101 through a ribbon 46 for thereby obtaining a character imprint thereon.

Figure 2:
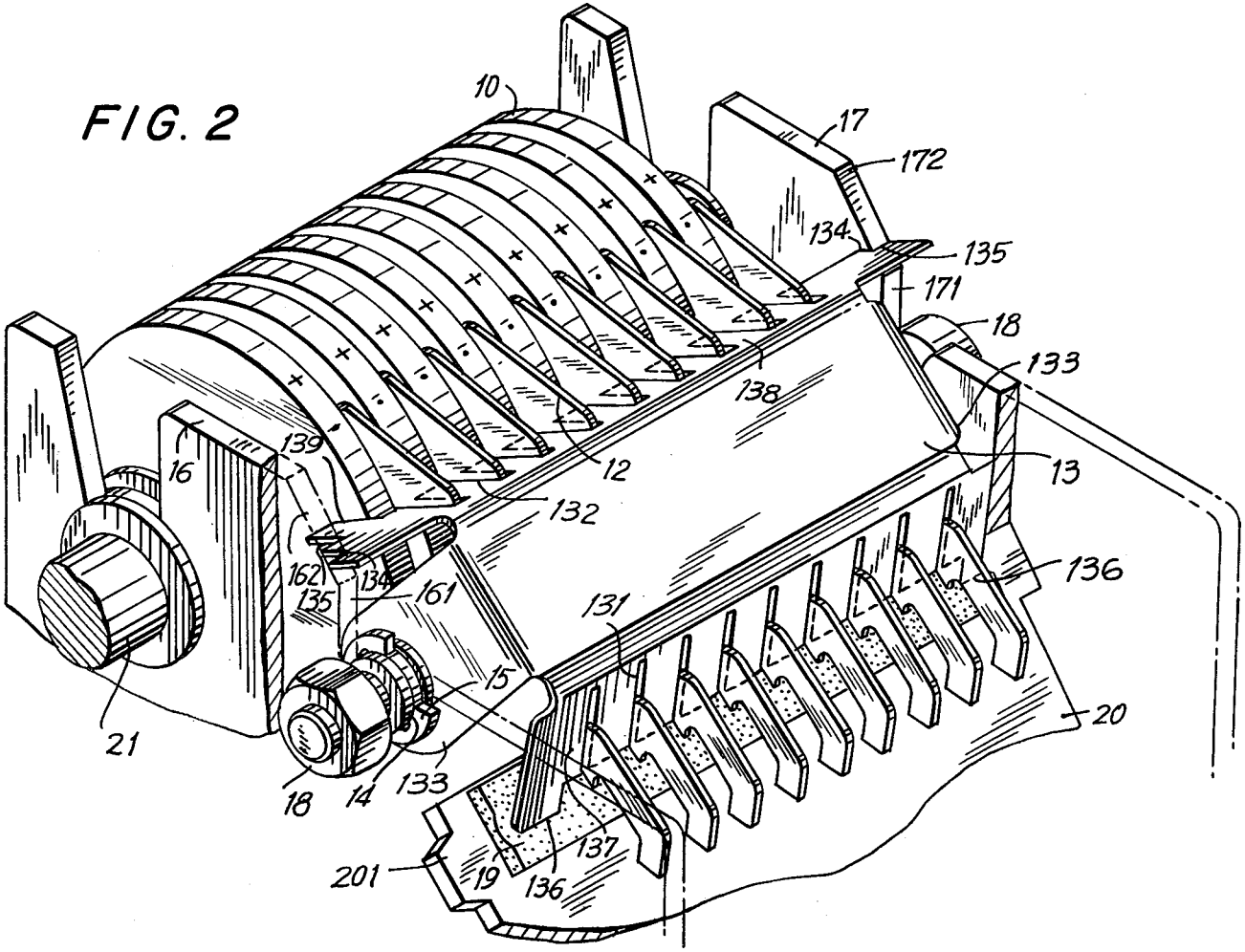
FIG. 2 is a perspective view showing in detail the pawl and pawl guide mechanism of the device.

FIG. 2 illustrates a means for guiding pawls 12. A pawl guide member 13 having substantially a U-shape includes a first leg 137, a second leg 138, and a pair of opposed inwardly turned members 133 for mounting pawl guide member 13 on shaft 14. Each pawl 12 is mounted on shaft 14 and is guided by correspondingly aligned slots 131 and 132 provided respectively in the first and second legs 137 and 138. Pawl 12 is rotatable on shaft 14 through slots 131 and 132. Pawl guide member 13 is mounted on shaft 14 and inwardly turned members 133 thereof provide the connection. Ring shaped stoppers 15 are fitted on shaft 14 for preventing pawl guide member 13 from slipping therefrom.

The assembly of shaft 14, pawls 12 and pawl guide member 13 is releasable from the device and is easily hand-carried and remountable on frames 16 and 17. Leg 138 has a pair of parallel faces 134 for defining a width approximately equal to an inside interval between the frames 16 and 17. When shaft 14 is fixed in a groove 161 of the frame 16 and a groove 171 of the frame 17 with nuts 18, parallel faces 134 are guided along the inside surfaces of frames 16 and 17 and movement of pawl guide member 13 in the direction of rotation of shaft 14 is controlled by the inside surface of the frames 16 and 17, and is, concomitantly small. Accordingly, pawls 12 are arranged correspondingly by reference to frames 16 and 17. Stoppers 135 provided on leg 138 are stopped against an edge 162 provided on frame 16 and an edge 172 provided on frame 17, while projections 136 of leg 137 are stopped against elastic member 19 which is for instance fabricated of rubber and adhesively connected to member 201 provided on mounting plate 20. As mounted, elastic member 19 is elastically deformed due to the mounting of pawl guide member 13 over it. Due to its elasticity, elastic member 19 has a movement which exerts a bias on pawl guide member 13 and stoppers 135 are thereby constantly biased against edge 162 of frame 16 and edge 172 of frame 17, so that no circumferential play of pawl guide member 13 against shaft 14 occurs.

Each of the character rings 10 pivotably mounted on shaft 21 is guided between a pair of pawls 12. However, the end ring proximate frame 16, is guided between a pawl 12 and a nub 139 provided in leg 138 of pawl guide 13. Therefore, its movement in the thrust direction of shaft 21 is limited. Accordingly, the positions and the pitch of character rings 10 are not determined by any guide means, but rather by pawls 12 and pawl guide 13.

Figure 3:
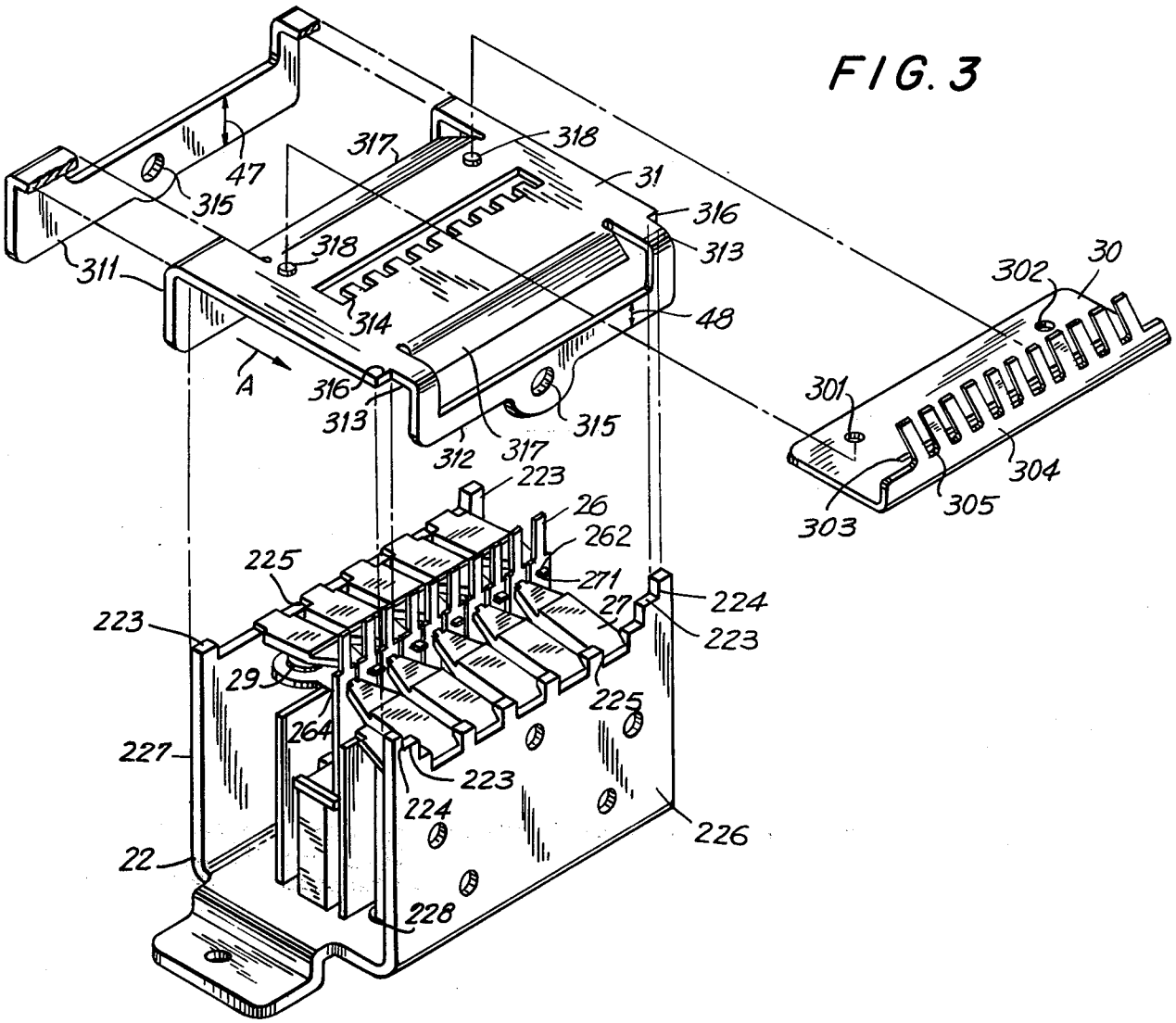
FIG. 3 is an exploded view showing the restraining means for biasing and releasing the pawls employed in the device.

FIG. 3 illustrates a method of mounting first guide member 30 and second guide member 31. Yoke 22 has a U-shape and includes a first leg 226 and a second leg 227. Leg 226 is fixedly mounted on plate 20 by screw 23, as seen in FIG. 1. Legs 226 and 227 are provided with a plurality of guide grooves 225 for accommodating plates 27. Plates 27 are arranged in correspondence with iron cores 29 which are mounted zigzag at regular intervals on the yoke 22. Ends 271 of plates 27 are mounted in a respective plurality of apertures 262 provided in restraining members 26. Leg 226 of yoke 22 includes a pair of parallel edge faces 224 which are perpendicular to the pitch of restraining members 26. Additionally, legs 226 and 227 include four coplanar supports 223.

Second guide member 31 includes comb-shaped slots 314 substantially centrally located therein and a pair of columnar projections 318 which are substantially parallel with the line of comb-shaped slots 314. Further included therein are a first mounting foot 311, a second mounting foot 312 and angularly turned member 317 which are respectively parallel with slots 314. A width 47 of first mounting foot 311 is wider than a width 48 of the second mounting foot 312. Both mounting feet are provided with a mounting aperture 315. Additionally, second guide member 31 includes a pair of stopper faces 316 parallel with slots 314, and a pair of parallel edge faces 313.

When second guide member 31 is mounted on supports 223, parallel edge faces. 313 are mounted between edge faces 224, and restraining members 26 are mounted in respective slots 314. Parallel edge faces 224 of yoke 22 control the play of the second guide member 31 in a direction parallel to the line of restraining members 26, and the play thereof is small. Slots 314 in second guide member 31 determine the pitch of restraining members 26. When stopper faces 316 contact leg 226 of yoke 22, gaps are provided between first mounting foot 311 and second leg 227 as well as between second mounting foot 312 and first leg 226. First mounting foot 311 is fixedly connected to second leg 227 by a screw (not shown) threaded through the mounting aperture 315, and similarly, second mounting foot 312 is fixedly connected to first leg 226. Since the width 47 of first mounting foot 311 is wider than the width 48 of second mounting foot 312, there occurs a difference in resilient force caused by the bending. Accordingly, second guide member 31 is biased forwardly in a direction A, with its stopper faces 316 being continuously pressed closely against first leg 226. Thus, the surface of first leg 226 which contacts plate 20, shown in FIG. 1 and columnar projections 318 are located a predetermined distance apart.

First guide member 30 includes an aperture 301, an elliptic aperture 302 and a slot 303. It further includes an arm 304 bent in parallel with slot 303, and arm 304 is provided with comb-shaped guide grooves 305. Columnar projections 318 provided in second guide member 31 are mounted in aperture 301 and elliptic aperture 302 provided in first guide member 30 whereby first guide member 30 is nested on second guide member 31. Slot 303 which is parallel with first leg 226 guides restraining member 26 which is mounted therein. Guide grooves 305 provided in arm 304 correspond, respectively, to slots 314 provided in second guide member 31. Each guide groove 305 prevents a corresponding pawl 12, as shown in FIG. 1, from being disengaged from a restraining member 26, since a portion of pawl 12 proximate tail portion 122 thereof is mounted in guide groove 305.

Stopper faces 316 of second guide member 31 are fixed against first leg 226 of yoke 22 whereby the distance 33, as seen in FIG. 1, may be predetermined. If, in FIG. 1, the distance 33 is incorrect, then tail portion 122 of pawl 12 and end 261 of the corresponding restraining member 26 will engage at an undesirable position. If the distance 33 is larger than desirable, pawl 12 will rotate through a larger angle for selecting a character, and it would take a longer time for pawl 12 to engage a corresponding tooth of ratchet wheel 102. On the other hand, if the distance 33 is too small, then an engaging portion 125 of pawl 12 intrudes into the path of a tooth of the ratchet wheel when the tail portion 122 and end 261 engage each other, thereby interrupting the normal functional operation of the device.

Figure 4:
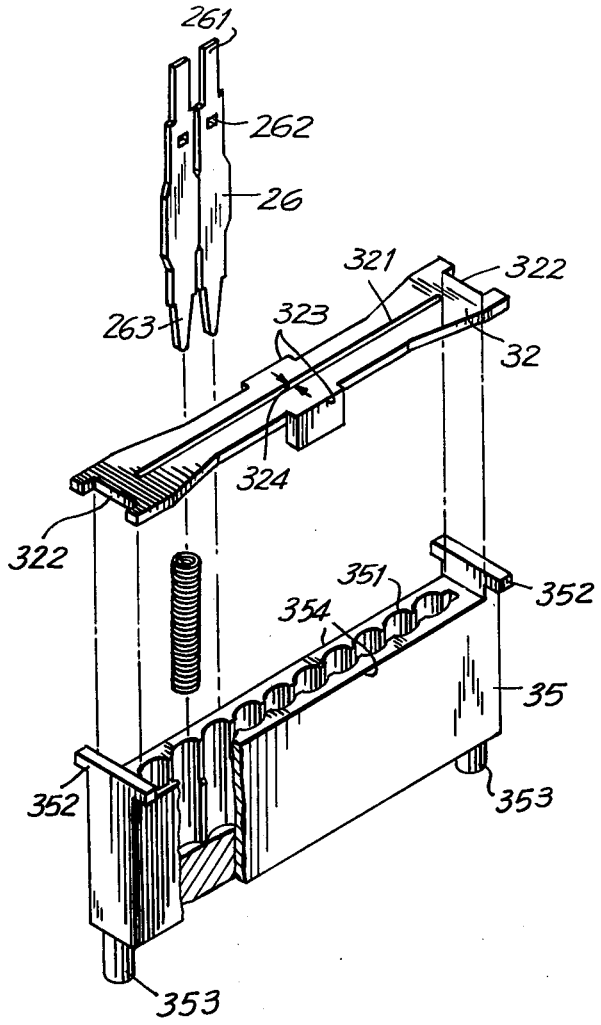
FIG. 4 is an exploded view showing a means for moving the restraints on the pawls upwardly and downwardly.

As seen in FIG. 4, a portion of each restraining member 26 proximate tail portion 263 thereof is guided in slot 321 of third guide member 32. Guide member 32 is mounted on supporter 35 in such a way that recesses 322 provided in guide member 32 engage respective T-shaped shoulders 352 is supporter 35, and compression springs 34 are housed in respective cylindrical channels 351 provided in supporter 35. Since guide member 32 is resilient, it is deformed when its ends are mounted under shoulders 352 of support 35 and, returns to a flat position after it is mounted. Projections 323 of guide member 32 bridge across both sides 354 of supporter 35, therefore, if the central width 324 of slot 321 of guide member 32 is narrowed, it may be widened to a predetermined distance by the projections 323. Supporter 35 is connected to yoke 22 as seen in FIG. 1, in such a way that columnar projections 353 are mounted in apertures (not shown) provided in yoke 22.

Respective tail portions 263 of restraining members 26 are mounted in compression springs 34 and normally biased upwardly as seen in FIG. 1.

Figure 5:
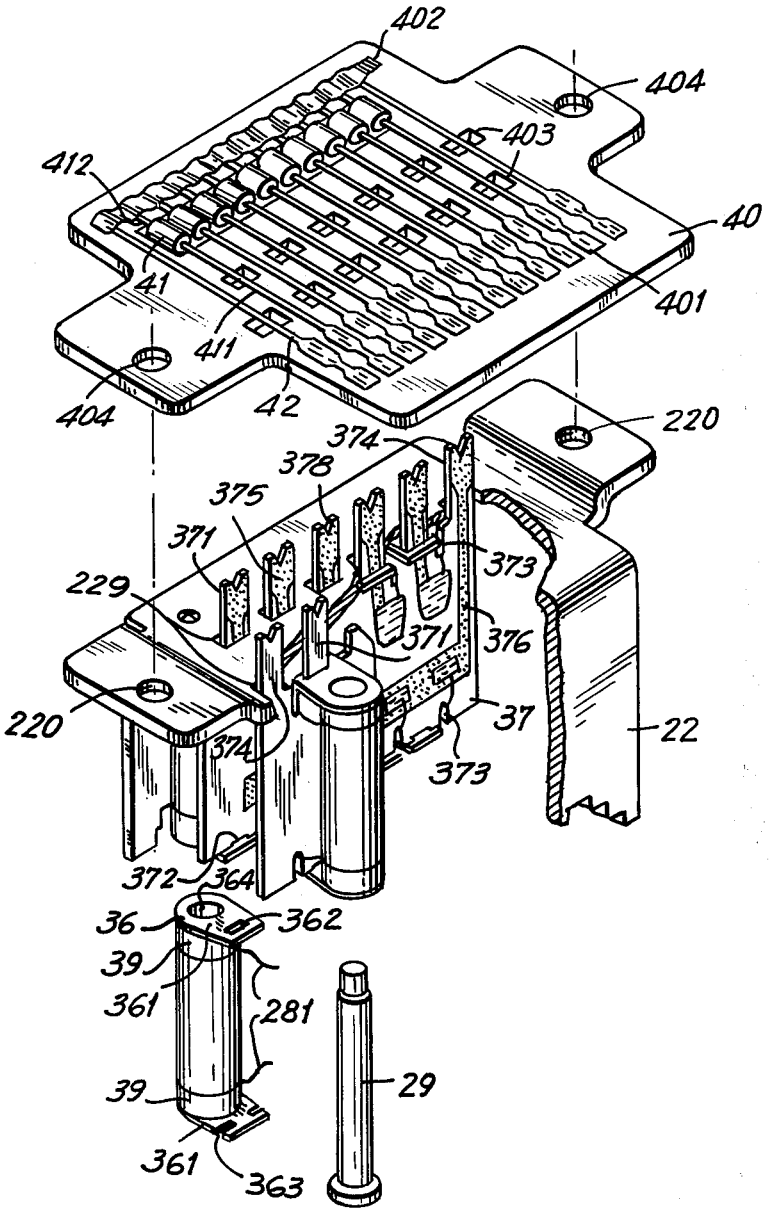
FIG. 5 is a perspective view showing a means for actuating the electromagnetic coils in the device and thereby transducing an electrical signal to a mechanical action of the pawl restraints.

As seen in FIG. 5, flanges 361 of the bobbin 36 are provided with an aperture 362 and notches 363. Coil terminal leads 281 of electro-magnetic coil 28 wound around bobbin 36, as seen in FIG. 1, are withdrawn at a distance from flanges 361 by tapes 39.

Each of the first print base plates 37 has first projections 371 disposed at regular pitches, mounting grooves 372 each of which corresponds to each of the first projections 371, and a second projection 374 next to the line of the first projections. The first and second projections, respectively, 371 and 374 are provided with grooves 378 at respective upper ends thereof. A groove 373 is provided adjacently to each first projection 371 and each mounting groove 372. A first copper foil 375 and a second copper foil 376 are provided on first projections 371 and the second projection 374 respectively, extending into groove 378 of each.

Each bobbin 36 is mounted on first print base plate 37 whereby first projection 371 is fitted into mounting aperture 362 of bobbin 36 and notches 363 are engaged with the mounting groove 372. The two coil terminal leads 281 of each coil are soldered to independent first copper foil 375 and to common second copper foil portion 376 through the grooves 373. The two opposite first print base plates 37 with mounted bobbins 36 are mounted in yoke 22 whereby first projections 371 and second projections 374 extend through apertures 229 of yoke 22, and iron cores 29 mounted in apertures 364 of the bobbins are connected to yoke 22. The two lines of first projections 371 are disposed zigzag when mounted on yoke 22 at regular intervals as well as on iron cores 29.

Second print base plate 40 is provided with first copper foil portions 401 and second copper foil portions 402. Lead terminals 411 and 412 of electronic elements 41, opposite ends of conductive wires 42 on either side thereof are soldered to independent first copper foil portions 401 and common second copper foil portions 402. The second print base plate is further provided with apertures 403 and mounting apertures 404.

First projections 371 and second projections 374 are mounted through apertures 403 whereby grooves 378 of first projections 371 hold lead terminals 411 of elements 41 and grooves 378 of second projections 374 hold conductive wires 42. Lead terminals 411 are soldered to first copper foil portions 375 of the first print base plates 37, and conductive wires 42 are soldered to the second copper foil portions 376 thereof.

The second print base plate 40 is connected to yoke 22 by screws or the like through the mounting apertures 404. When a voltage is applied across the conductive wire 42 and the first copper foil portion 401 of the second print base plate 40, a current is applied to the corresponding coil 28, seen in FIG. 1.

In practice, shaft 21 is partially surrounded by a torsion coil spring (not shown) which rotationally biases shaft 21 in the direction B. A part of the shaft 21 (not shown) is biased against an externally mounted stopper, (not shown) for maintaining the stability of shaft 21. On a print command, shaft 21 is rotated in the direction C by an external driving means, not shown, with the torsion coil spring, not shown, being wound up. When inwardly turned portion 112 of spring 11 is in notched groove 211 of shaft 21, portion 112 of spring 11 is biased against notched groove 211 by the elastic force of spring member 11. Accordingly, shaft 21 and character ring 10 are rotated in direction C since they are associated with each other in a predetermined relation.

Immediately before a preselected character 101 which is to be printed passes a position facing a platen 44, a current is applied to electro-magnetic coil 28 through second print base plate 40 and first print base plates 37 whereby plate 27 is attracted towards iron core 29. Consequently, restraining member 26 is biased downwardly against the resiliency of compression spring 34. Since tail portion 122 of pawl 12 is inclined, it is rotated in direction D by the action of spring 25 engaged in crook 121 of pawl 12 as restraining member 26 is urged downwardly. When tail portion 122 of pawl 12 completely disengages from end 261 of restraining member 26, pawl 12 is rotated freely to phantom position 123 whereby pawl 12 engages a tooth of ratchet wheel 102 corresponding to a preselected character 101 for stopping character ring 10 in a predetermined position, whereby preselected character 101 faces platen 44. End 261 of restraining member 26 is caught by an edge 126 of pawl 12. Shaft 21 continues to rotate after pawl 12 stops character wheel 101 and portion 112 of spring 11 disengages from notched groove 211 and osculates shaft 21 at its circumference.

While the shaft 21 is rotated in the direction C through a predetermined angle of rotation, respective characters 101 of the columns to be printed are aligned facing platen 44, and for the columns of the print out which are to remain blank spaces 104 lacking characters 101 are provided and aligned facing the platen. After shaft 21 is rotated in direction C through the predetermined angle of rotation, it is stopped by an arresting member (not shown) and platen 44 is biased against aligned characters 101 through ribbon 46 and print paper 45 for obtaining a print out.

After the print out is obtained, return shaft 43 is rotated in a direction F for rotating pawl 12 in direction E whereby segment 125 thereof is removed from the rotational path of the teeth of ratchet wheel 102. When return shaft 43 is rotated to phantom position 431, pawl 12 is rotated slightly in direction E from its solid line position wherein it is engaged with end 261 of restraining member 26. Simultaneously, restraining member 26 is biased upwardly by compression spring 34, and end portion 261 thereof is positioned for engagement with tail portion 122. Thus pawl 12 is reset.

After pawl 12 has been reset, shaft 21 which has been constrained is released from the arresting means not shown. Shaft 21 thereby rotates in direction B due to the torque of the torsion coil spring which built-up therein when shaft 21 was rotated in direction C. Character rings 10 of unprinted columns are rotated simultaneously with shaft 21 as segments 112 of corresponding spring members 11 are mounted in notched grooves 211. Other character rings 10 of printed columns are biasingly rotated in direction B when corresponding segments 122 are mounted in notched groove 211 of shaft 21, however, initially character rings 10 are stopped, or rotated slightly in direction B due to relative sliding on the circumference of shaft 21 and the bias of segments of spring member 11.

When shaft 21 is rotated in direction B to the position as shown in FIG. 1, shaft 21 is stopped almost instantaneously by an externally mounted stopper, not shown, against which a portion of shaft 21, not shown, abuts. Since each character ring 10 has a kinetic energy due to inertia, each is respectively rotatable in direction B further than is desirable, therefore, a stopper 105 is provided on ratchet wheel 102 which abuts an extension 127 of pawl 12. After its initial abutment against extension 127, stopper 105 slides upwardly along extension 127 and rotates pawl 12 in direction E to a phantom position 129. The kinetic energy of the character ring 10 is thereby absorbed by elastic member 19, which is distorted by a second extension 128 provided in pawl 12. Stopper 105 is inclined against the radial direction of the character ring 10 by an angle $\theta$ generally designated by numeral 106 for protecting stopper 105 from wear by providing a relatively long slide of the stopper 105 along extension 127. Stopper 105 is additionally protected against wear by elastic member 19 which absorbs the kinetic energy of the character ring 10. Although the character ring 10 which has just rotated the pawl 12 to phantom position 129 is positioned in such a way that the bent portion 112 of the spring member 11 is partially out of notched groove 211, the character ring 10 returns to the position shown due to the elastic force of spring member 11 exerted towards the center of the shaft whereby the bent portion 112 thereof fits into notched groove 211 again.

Return shaft 43 is rotated in a direction G from phantom position 431 to the position as shown by the solid line. Thus, a series of printing operations may be accomplished.

As above-described, an improved printer constructed according to this invention includes relatively few component elements and is compact. Accordingly, the size of this improved printer is reduced and assembly thereof is facilitated. Furthermore, this improved printer is efficient, accurate and has a long useful life.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved printer comprising a rotatable drive shaft means at least one character ring having a plurality of characters on the periphery thereof, said character ring being rotatably supported on said drive shaft means, each character ring having a ratchet wheel including a stop tooth radially mounted thereon, pawl means associated with each said character ring, each said pawl means being coordinately displaceable between a rest position and an engaging position, each said pawl means being adapted to engage the ratchet wheel on said associated character ring when said pawl means is in said engaging position to thereby stop the rotation of said character ring, each said pawl means having a first extension and a second extension, said first extension being constructed and arranged to contact the stop tooth on said ratchet wheel when said ratchet wheel is rotated by said drive shaft means to a predetermined rotary position of said ratchet wheel, said stop tooth imparting motion to said pawl means, a biasing means associated with each pawl means for displacing said pawl means from said rest position to said engaging position, restraining means associated with each said pawl means for selectively engaging said pawl means and holding same at said rest position, release means associated with each said restraining means for displacing said restraining means out of engagement with said pawl means to thereby permit said biasing means to effect displacement of said pawl means from said rest position to said engaging position, return means for returning each of said pawl means from said engaging position to said rest position, and resilient means disposed proximate to said second extension on each said pawl means when said pawl means is in said rest position so that said resilient means is engaged by said pawl means and absorbs the motion imparted to said pawl means when the first extension of each said pawl means is engaged by said stop tooth on said ratchet wheel, when said ratchet wheel is rotated to said predetermined position, and print means for imprinting a selected character carried on each of said character rings when said character ring is stopped by said pawl means associated therewith.

2. An improved printer as claimed in claim 1, and including guide means located adjacent to said pawl means for preventing any motion of said pawl means other than said displacement between said rest position and said engaging position.

3. An improved printer as claimed in claim 2, and including a support shaft on which each of said pawl means are pivotally mounted, said guide means including a configured frame mounted on opposite ends of said support shaft, said frame including respective pairs of aligned slots, each pair of aligned slots being associated with a single pawl means, said pawl means being pivotable on said shaft between said rest position and said engaging position through the pair of aligned slots in said frame.

4. An improved printer as claimed in claim 1, wherein said release means includes magnetic means for effecting selective displacement of said restraining means out of engagement with said associated pawl means.

5. An improved printer as claimed in claim 1, wherein said drive shaft means includes notched grooves, each of said character rings and radially mounted ratchet wheel being respectively rotatably mounted on said drive shaft means, said ratchet wheel having an interior slot and said associated character ring having a recess associated with said slot, a spring housed in said slot and associated recess, said spring having an end connected to said recess in said character ring, and another end releasably connected in said notched groove provided in said shaft.

6. An improved printer as claimed in claim 5, wherein said pawl means biasing means is a comb shaped spring.

7. An improved printer as claimed in claim 1, wherein said restraining means includes an upstanding reciprocally displaceable standard for each said pawl means, each of said standards being adapted to be displaced into abutting engagement with said pawl means, a housing having a guide slot therein through which said standard is reciprocally displaceable, and further biasing means mounted in said housing for biasing said standard into abutment with said pawl means to maintain said pawl means at said rest position.

8. An improved printer as claimed in claim 7, wherein the portion of each said pawl means disposed in abutting engagement with said standard having a surface inclined with respect to the direction that said standard is reciprocally displaceable.

* * * * *